US005967314A

United States Patent [19]

McGovern

[11] Patent Number: 5,967,314

[45] Date of Patent: Oct. 19, 1999

[54] SNOWBOARD PROTECTIVE COVER

[75] Inventor: Paul R. McGovern, Phoenix, Ariz.

[73] Assignee: Snow Hombres L.L.C., Phoenix, Ariz.

[21] Appl. No.: 09/065,138

[22] Filed: Apr. 23, 1998

Related U.S. Application Data

[60] Provisional application No. 60/044,395, Apr. 28, 1997.

[51] Int. Cl.[6] ..... B65D 85/20

[52] U.S. Cl. ..... 206/315.1; 206/523; 150/154

[58] Field of Search ..... 206/315.1, 523, 206/592, 594; 150/154; 224/191, 901, 917

[56] References Cited

U.S. PATENT DOCUMENTS

| | | | |
|---|---|---|---|
| 4,006,912 | 2/1977 | Perlich et al. . | |
| 4,012,050 | 3/1977 | Miller . | |
| 4,196,762 | 4/1980 | Goodwin et al. | 150/154 |
| 4,483,380 | 11/1984 | Beran | 150/154 |
| 4,620,633 | 11/1986 | Lookholder | 206/523 |
| 4,644,986 | 2/1987 | Fusaro | 150/154 |
| 4,719,952 | 1/1988 | Geronimo . | |
| 4,993,549 | 2/1991 | Diard et al. | 206/315.1 |
| 5,013,068 | 5/1991 | Maldonado | 281/31 |
| 5,092,506 | 3/1992 | Boldue . | |
| 5,163,550 | 11/1992 | Hawk . | |
| 5,664,808 | 9/1997 | Whidden et al. | 280/815 |

*Primary Examiner*—Paul T. Sewell
*Assistant Examiner*—Nuan T. Lam
*Attorney, Agent, or Firm*—Head Johnson & Kachigian

[57] ABSTRACT

A removable cover for a snowboard having an elongated, longitudinally expandable bottom portion of configuration substantially that of a snowboard bottom surface and a C-shaped expandable collar secured to and circumscribing the bottom portion, the collar being configured to receive the circumferential edge of a snowboard.

11 Claims, 2 Drawing Sheets

SNOWBOARD PROTECTIVE COVER

REFERENCE TO PENDING APPLICATIONS

This application claims the benefit of and incorporates by reference prior filed provisional application Ser. No. 60/044,395 filed Apr. 28, 1997 entitled "Snowboard Protective Cover".

REFERENCE TO MICROFICHE APPENDIX

This application is not referenced in any microfiche appendix.

BACKGROUND OF THE INVENTION

Snow skiing is one of the fastest growing participation sports in the world as more and more skiing facilities have been constructed. Like waterskiing which started with skiers using a ski on each foot as pulled by means of a rope behind a power boat that evolved into the typical water skier using a single ski or "slalom" ski, in recent years the use of a single ski for snow skiing has also grown in popularity. A single ski for use on snow is commonly known as a "snowboard". Present snowboards bear little resemblance to a typical ski in that they are shorter, wider and of different contour. A good snowboard is designed to incorporate a flat bottom surface, rounded front and tail ends with square, sharp edges extending from the front to the tail. The smoothness and condition of the bottom surface and the sharpness of the side edges are critical in obtaining superior performance by a skilled user of a snowboard. Skilled snowboard users frequently have more than one snowboard, that is, a longer model for mountain skiing and a shorter model for the popular snowboard parks where more acrobatic skills are employed.

Because of the criticality of maintaining a smooth bottom surface and sharp edges on the sides of the snowboard, they are susceptible to damage. Particularly, the critical cutting edges of the sides are easily damaged when a snowboard is transported from one place to another, such as in a trunk of an automobile.

An object of the present invention is to provide a protective cover for a snowboard to protect the board both in transit and storage, and particularly, to protect the smooth bottom surface and the edges of the sides. Further, an important aspect of the invention is the provision of a protective cover having means to adjust to properly fit and envelope the entire base, edges, and sidewalls of various length snowboards.

Others have provided protective covers for various board types of sporting equipment. As an example, U.S. Pat. No. 4,006,912 entitled "Ski Protector" that issued on Feb. 8, 1977 provides a one-piece ski protector of material that can be stretched sufficiently so as to enable the skier to fit one end of the protector over the toe end of the ski and the other end over the heel end, the resiliency or elasticity permitting use of the device on various sizes of skis. While the ski protector disclosed in this patent teaches the basic concept of a device having elastic qualities to stretch over the opposed ends of a ski it does not provide components to protect the bottom surface of a snowboard nor does it provide sufficient protection for the side edges.

U.S. Pat. No. 4,012,050 also entitled "Ski Protector" includes a ski-shaped rubber boot that stretches over the ends, longitudinal edges and bottom of a ski but, as has been stated with reference to U.S. Pat. No. 4,006,912, the structure in U.S. Pat. No. 4,012,050 does not provide adequate protection for the bottom surface of a snowboard nor sufficient padding for protection of the cutting edges along the snowboard sides.

U.S. Pat. No. 4,719,952 entitled "Surfboard Horizontal Control Surface Protection Method and Apparatus" that issued on Jan. 19, 1988 shows an apparatus for protecting a surfboard but in which only the edges of the surfboard are protected from the forward to the rearward end and along both sides but wherein the bottom surface remains unprotected. Applying the principles of this invention to a snowboard would not afford to a user necessary protection of the critical bottom surface. Further, this patent shows a device having relatively thin material along the side edges and in general does not provide the protection required for a snowboard.

U.S. Pat. No. 5,092,506 entitled "Skateboard Carrier" that issued on Mar. 3, 1992 provides a carrier specifically for a skateboard of the type that has wheels and includes individual right wing and left wing portions with a plurality of inflation chambers and including the use of straps having Velcro attachments. This patent is primarily concerned with a way to encompass a skateboard to facilitate carrying the skateboard and is not specifically concerned with protection of a skateboard bottom surface, since such surface has wheels mounted thereon, nor the side edges since the integrity of the side edges of a skateboard are not relevant to the use of the board.

U.S. Pat. No. 5,163,550 entitled "Protective Cover For Snowboard or The Like" issued Nov. 17, 1992 illustrates a protective cover having an elastic elongated panel having an elastic cord around its outer peripheral edge that is stretched in order to permit the insertion of a snowboard so that the bottom of the snowboard is covered by the panel and the elastic cord engages the top surface of the panel with reinforcing layers provided along the surrounding edges of the panel to overlap the edges of the snowboard. This device provides for protection of the edges of the snowboard but relies primarily upon Velcro-type straps to hold it in position and does not provide for adequate protection of the board bottom. Particularly, the device as shown in U.S. Pat. No. 5,163,550 does not show a snowboard cover that provides secure protection for the bottom surface but is nevertheless expandable so that the cover can accept a variety of lengths of snowboards.

These previously issued United States patents are representative of the state of the art to which the present invention is directed and illustrate that, while others have demonstrated an appreciation of the need to protect boards used in sporting activities, none have provided protection for all the critical areas required for a snowboard.

A better understanding of the invention will be obtained from the following description of the preferred embodiments and claims, taken in conjunction with the attached drawings.

DETAILED DESCRIPTION OF THE PREFERRED EMBODIMENTS

Figure 1:
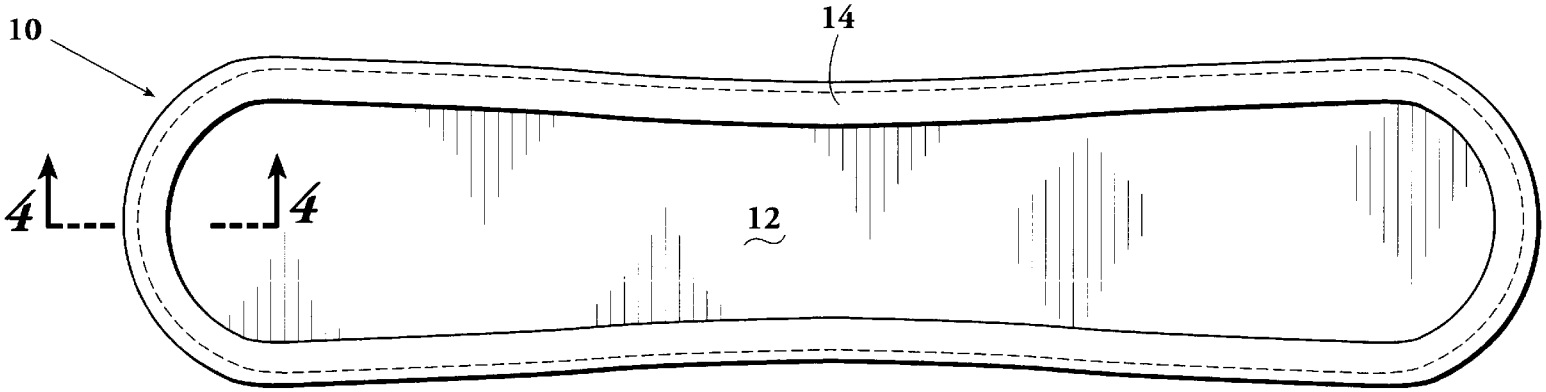
FIG. 1 is a top plan view of a snowboard cover that incorporates the principals of this invention.
Figure 2:
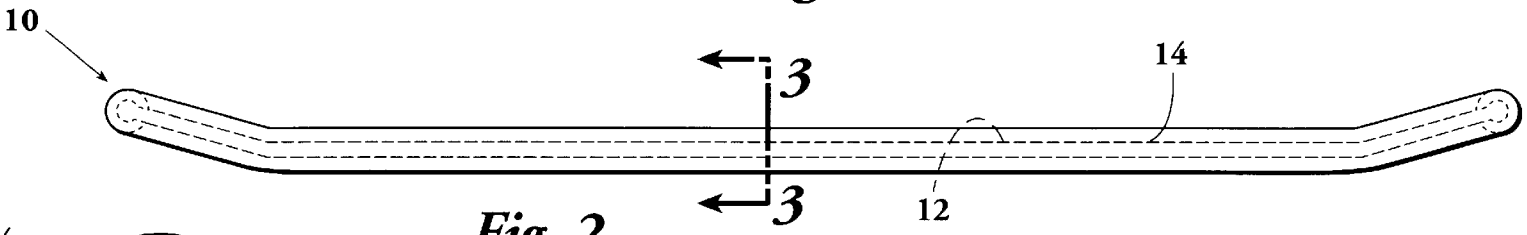
FIG. 2 is an elevational view of the snowboard cover as shown in FIG. 1.

Referring to the drawings and first to FIGS. 1 and 2, the basic external appearance of a snowboard cover that incorporates the principal of this invention is shown. The snowboard cover is indicated generally by the numeral 10. In completed form it is an integral device, that is, a cover that does not require separate components such as straps, binders or the like. Snowboard cover 10 has a bottom 12 that in planar view and elevational view is generally configured to match a snowboard for which the cover is dimensioned. Snowboards vary in size although those on the market at this time have a commonality in their basic geometrical configurations and the snowboard cover of this invention is specifically designed and constructed so as to adjust to a variety of sizes, however, it is understood that in the preferred practice of the invention more than one basic size snowboard cover may be desirable. That is, in the actual practice of the invention at a commercial level ideally there will be more than one size of snowboard covers however there does not need to be a separate snowboard cover for every specific size or shape of snowboards.

Figure 3:
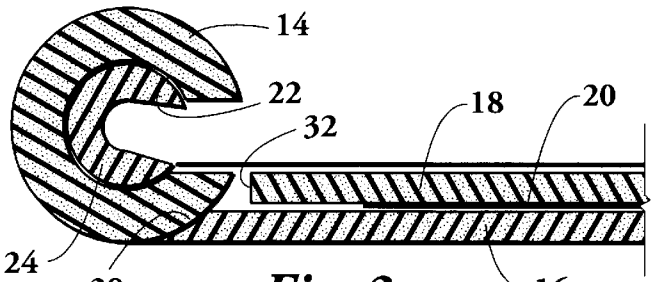
FIG. 3 is an elevational cross-sectional view of one of the side edges of the snowboard cover, taken along the line 3—3 of FIG. 2.
Figure 4:
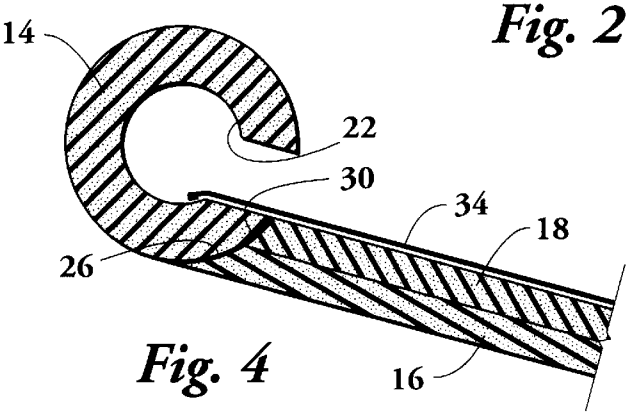
FIG. 4 is an elevational cross-sectional view of the forward end portion of the snowboard cover of FIG. 1, as taken along the line 4—4 of FIG. 1.

Surrounding the snowboard cover bottom 12 is a circumferential collar 14 that, as shown in FIGS. 3 and 4, is of generally C-shaped configuration.

The base or bottom 12 of the snowboard cover is formed of a bottom layer 16 and top layer 18. Each of the layers 16 and 18 are preferably formed of a tough cellular foam plastic, preferably of about ¼ in thickness arranged in longitudinal patterns as will be described subsequently. Positioned between bottom layer 16 and top layer 18 is a thin elastomeric sheet, the elastomeric sheet being indicated by the numeral 20.

Collar 14 that circumscribes the snowboard cover can be formed of cellular foam tubing such as manufactured by "IMCOA". The dimensions of collar 14 may be such as 7/16" I.D. by 3/8" wall or 7/8" I.D. by ½" wall. The C-shaped cross-sectional configuration of collar 14 leaves an interior opening 22 that circumscribes the carrier to receive the complete peripheral surface of a snowboard.

Along the side edges of the snowboard cover, as seen in FIG. 3, a supplementary C-shaped padding 24 is preferably employed. Padding 24 is added to reinforce the protection of the snowboard longitudinal side edges since the sharp corners formed by the snowboard side edges are important to the performance of the snowboard and these critical sharp edges are easily damaged in the transportation and storage of a snowboard.

Figure 5:
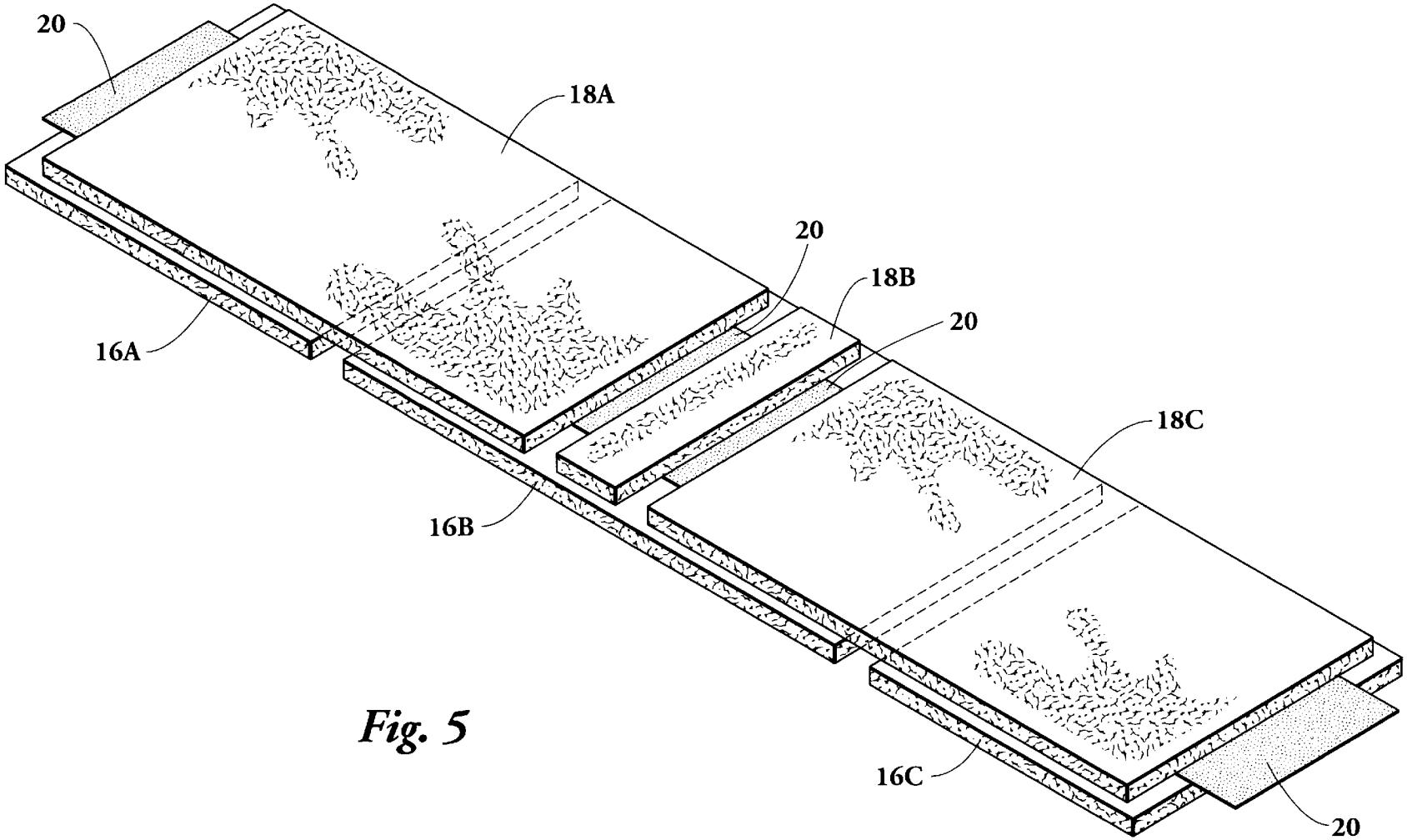
FIG. 5 is an isometric enlarged diagrammatic view of the components making up the base of the snowboard of FIGS. 1 through 4.

The construction of the snowboard bottom is best illustrated in the diagrammatic view of FIG. 5. To facilitate longitudinal expansion of the snowboard cover to fit snowboards of varying lengths, the bottom layer 16 is formed of individual components or pads, identified by 16A, 16B and 16C. In like manner, the top layer 18 is formed of multiple components or pads and arranged so as to provide for overlapping of the bottom pads. In FIG. 5, the top layer pads are indicated by 18A, 18B and 18C. It is understood that the number of pads making up the bottom and top layers may vary, however, it is important in practicing the invention that the ends of the top layer pads (18A, 18B and 18C) overlap with respect to the ends of the pads making up the bottom layers (16A, 16B and 16C). Elastomeric sheet 20 is positioned between bottom layer 16 and top layer 18 and is bonded to the top and bottom layers adjacent the opposite ends of the elastomeric sheet but the elastomeric sheet is preferably not bonded in the intermediate portion between the opposed ends of the snowboard so as to permit the length of the snowboard bottom, made up of layers 16 and 18, to expand relative to each other.

The forward peripheral edge 26 of bottom layer 16 (See FIG. 4) is secured to collar 14 by means of an adhesive. In like manner, the longitudinal side edges 28 of bottom layer 16 are secured to collar 14 by adhesive (See FIG. 3). Thus, the edges of the bottom layer 16 are attached around the full periphery of collar 14, however, the elasticity of collar 14 allows the various bottom layer pads, such as pads 16A, 16B and 16C as seen in FIG. 5, to expand relative to each other.

As seen in FIG. 4, the forward edge 30 of top layer 18 is bonded, such as by means of adhesive, to collar 14. However, as seen in FIG. 3, the longitudinal side edges 32 of top layer 18 are not bonded to collar 14 so as to permit the collar to stretch with respect to the top layer, and particularly to stretch with respect to top layer pads 18A, 18B and 18C (See FIG. 5).

Elastomeric sheet 20 is seen in FIG. 3 since it extends from adjacent the front to adjacent the rearward end of bottom 12 but is not seen in FIG. 4 since the sheet is secured to both the bottom layer 16 and top layer 18 at locations adjacent to but spaced away from the bottom front and rearward ends.

Covering the upper surface of top layer 18 and extending within opening 22 formed in collar 14, is a finish layer of elastomeric material, identified by the numeral 34. The circumferential edge portion of finish layer 34 is bonded to collar 14 around the entire periphery of the collar. Elastomeric finish layer 34 acts in conjunction with sheet 20 and the elasticity provided by collar 14 to permit the cover to resiliently expand lengthwise so as to encompass snowboards of varying lengths.

The bottom and top layers 16 and 18 are, as previously indicated, preferably made of cellular foam plastic pads. A material commercially available that is suitable for construction of the bottom and top layer pads is sold under the name "RUBATEX". Collar 14 can be successfully made from a cellular foam tubing product sold under the trademark "IMCOA". These commercially available products are representative of the type of materials that can be employed in practicing the invention may be manufactured by using other materials or, may be made in the future by suitable products that do not commercially exist today. Where adhesive is required, contact cement is preferred.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A removable cover for a snowboard of a type that has a bottom surface and a circumferential edge, the cover comprising;

an elongated, longitudinally expandable bottom portion of a configuration substantially that of said snowboard and having a bottom portion circumferential edge, the bottom portion being formed of a top layer of multiple cellular foam plastic pads and a bottom layer formed of multiple cellular foam plastic pads, the bottom and top layers being separated by an elastomeric sheet; and an expandable collar that is generally C-shaped in cross-sectional configuration secured to and circumscribing said bottom portion circumferential edge, the collar being configured to displaceably receive said snowboard circumferential edge.

2. A removable cover for a snowboard according to claim 1 wherein said collar is formed of cellular foam plastic.

3. A removable cover according to claim 2 wherein said collar is formed of a cellular foam tubing.

4. A removable cover for a snowboard according to claim 1 wherein said top layer is formed of multiple cellular foam plastic pads having ends, some-of which overlap ends of cellular foam plastic pads making up said bottom layer.

5. A removable cover for a snowboard according to claim 1 including:

an elastomeric sheet finish layer overlaying said bottom portion top layer of cellular foam plastic pads.

6. A removable cover for a snowboard of a type that has a bottom surface and a circumferential edge, the cover comprising;

a bottom portion formed of overlapping multi-segmented top and bottom layers of cellular foam plastic pads, the bottom portion being configured to engage said snowboard bottom surface and the bottom portion having a circumferential bottom portion edge; and an expandable collar that is C-shaped in cross-section and that is bonded to said bottom portion circumferential edge, the collar being configured to displaceably receive said snowboard circumferential edge to thereby hold said bottom portion in contact with said snowboard bottom surface.

7. A removable cover for a snowboard according to claim 6 wherein said collar is formed of cellular foam plastic.

8. A removable cover according to claim 7 wherein said collar is formed of cellular foam tubing.

9. A removable cover for a snowboard according to claim 6 wherein said bottom portion is formed of a top layer of multiple cellular foam plastic pads and a bottom layer formed of multiple cellular foam plastic pads, the bottom and top layers being separated by an elastomeric sheet.

10. A removable cover for a snowboard according to claim 9 wherein said top layer is formed of multiple cellular foam plastic pads having ends, some of which overlap ends of cellular foam plastic pads making up said bottom layer.

11. A removable cover for a snowboard according to claim 9 including:

an elastomeric sheet finish layer overlaying said bottom portion top layer of cellular foam plastic pads.

* * * * *